United States Patent [19]

Garza

[11] Patent Number: 5,060,979

[45] **Date of Patent: * Oct. 29, 1991**

[54] INFORMATION PAD FOR CHECKBOOKS

[76] Inventor: Raul G. Garza, 12 Ollerton, Conroe, Tex. 77303

[ * ] Notice: The portion of the term of this patent subsequent to Mar. 27, 2007 has been disclaimed.

[21] Appl. No.: 465,429

[22] Filed: Jan. 16, 1990

Related U.S. Application Data

[63] Continuation-in-part of Ser. No. 331,834, Apr. 3, 1989.

[51] Int. Cl.[5] ..... B42D 3/00

[52] U.S. Cl. ..... 281/31; 281/29; 283/58; 283/64.1

[58] Field of Search ..... 281/29, 31, 15.1, 35, 281/39; 283/57, 58, 63.1, 64.1; 150/135

[56] References Cited

U.S. PATENT DOCUMENTS

| | | | |
|---|---|---|---|
| 735,081 | 8/1903 | Frano | 283/64.1 |
| 848,429 | 3/1907 | Berry | 283/64.1 |
| 2,574,885 | 11/1951 | Niswander | 281/31 |
| 3,267,841 | 8/1966 | Metcalf | 281/31 |
| 3,267,980 | 8/1966 | Bird | 281/31 |
| 3,980,323 | 9/1976 | Boyreau | 283/57 |
| 4,587,409 | 5/1986 | Nishimura et al. | 283/57 |
| 4,758,022 | 7/1988 | Podosek et al. | 281/15.1 |
| 4,911,476 | 3/1990 | Garza | 281/29 |

*Primary Examiner*—Frank T. Yost
*Assistant Examiner*—Hwei-Siu Payer
*Attorney, Agent, or Firm*—Harrison & Egbert

[57] ABSTRACT

An information pad for checkbooks that comprises a checkbook cover having flexible material, and an information receiving pad that is flexibly fastened to an edge of the checkbook cover. The checkbook cover is a type that has a suitable slot for receiving checkbooks. The information receiving pad has a size less than the area of the checkbook cover. The information receiving pad includes a backing layer and a plurality of flexible sheets detachably connected to the backing layer. The backing layer has a first planar surface and a second planar surface. The plurality of flexible sheets are suitable for the receipt of written information. A hinge member extends between the edge of the backing layer and the edge of the checkbook cover so as to allow the information receiving pad to be folded within the cover.

6 Claims, 4 Drawing Sheets

INFORMATION PAD FOR CHECKBOOKS

RELATED APPLICATIONS

The present application is a continuation-in-part of U.S. patent application Ser. No. 07/331,834, filed on Apr. 3, 1989, entitled "INFORMATION PAD FOR CHECKBOOKS", and now presently pending.

TECHNICAL FIELD

The present invention relates to checkbooks. More particularly, the present invention relates to checkbooks having information pads attached thereto.

BACKGROUND ART

In present checkbooks, it is often difficult to carry out computations, record information, and otherwise balance the checkbook without having an adjacent sheet of paper. Many times, checkbook users must conduct mathematical computations in the margins surrounding checkbooks, or in the ledger portion of checkbooks. Beyond the unsightly appearance of such margin calculations, these additional markings can create problems for banks and other persons that would process such checks. The appearance of these unsightly calculations within the ledger sheet could confuse the user and cause miscalculations in balancing one's checkbook.

Many present day checkbooks incorporate a calculator within the checkbook cover. Although this aids in the computation of various matters associated with checking activities, calculators are cumbersome and will not record a variety of information. In addition, calculators cannot be easily folded or stuffed into one's pocket haphazardly. Many times, calculators will run out of power, or will become defective with use. The use of calculators in conjunction with checkbooks is a costly endeavor by the checkbook manufacturer and is generally found to be unsuitable for consumer use.

U.S. patent application Ser. No. 07/331,834, filed on Apr. 3, 1989 by Raul G. Garza, the present inventor, incorporated a "magic slate" type of arrangement within a checkbook cover. After extensive usage, it was found that this "magic slate" was easy to incorporate into the checkbook. Specifically, the space was available which allowed the magic slate to be suitably folded within the confines of the cover of the checkbook. The magic slate was positioned so that the marking of the ledger or the marking of checks would not transmit written information onto the magic slate. Also, the magic slate could be stored such that the recorded information would no be erased by the separation of the associated impression layers of the magic slate. This was an extremely convenient arrangement for checkbook users.

As such, the present invention was developed so as to incorporate the benefits of the magic slate configuration of the prior patent application with a convenient writing pad.

It is an object of the present invention to provide an information pad for use in conjunction with a checkbook.

It is another object of the present invention to provide an information pad that is attached to the checkbook in an optimum manner.

It is still a further object of the present invention to provide an information pad that is very inexpensive, easy to manufacture, flexible, and easily utilized.

It is another object of the present invention to provide an information pad for a checkbook that includes space suitable for the receipt of advertising information.

These and other objects and advantages of the present invention will become apparent from a reading of the attached specification and appended claims.

SUMMARY OF THE INVENTION

The present invention is an information pad for checkbooks. This invention comprises a checkbook cover of flexible material and an information receiving pad that is flexibly fastened to an edge of the checkbook cover. The checkbook cover includes suitable means for receiving checkbooks therein. The information receiving pad serves to receive written information. This information receiving pad has a size less than the area of the checkbook cover so as to allow the information pad to be folded into the checkbook cover. This information receiving pad comprises, in particular, a backing layer having a first planar surface and a second planar surface, and a plurality of flexible sheets that overlays the first planar surface of the impression layer. The backing layer is of a generally flat cardboard material. The cardboard material should be sufficiently rigid so as to allow written information to be transferred onto the flexible sheets.

The plurality of flexible sheets are detachably connected to the backing layer. Specifically, these flexible sheets include a perforation that will allow easy removal after usage. These flexible sheets are made of paper and will receive information to be written thereon.

The information receiving pad may be seam welded to an edge of the inner plastic sleeve of the checkbook. Specifically, a hinge member extends between the edge of the backing layer of the information receiving pad and the edge of the checkbook cover. This hinge member causes the information receiving pad to be foldable into the inner side of the checkbook cover. In particular, the hinge member is fixedly fastened to the second planar surface of the backing layer. The second planar surface of the backing layer is suitable for the receipt of advertising information.

The backing layer and the flexible sheets are aligned and connected along the longitudinal edge of the information receiving pad.

In an alternative embodiment, the information receiving pad is provided with an adhesive strip located on the opposite side of the hinge member from the second planar surface of the backing layer. This adhesive strip allows the information receiving pad to be suitably attached in hinged relationship to the edge of the checkbook cover.

DETAILED DESCRIPTION OF THE INVENTION

Figure 1:
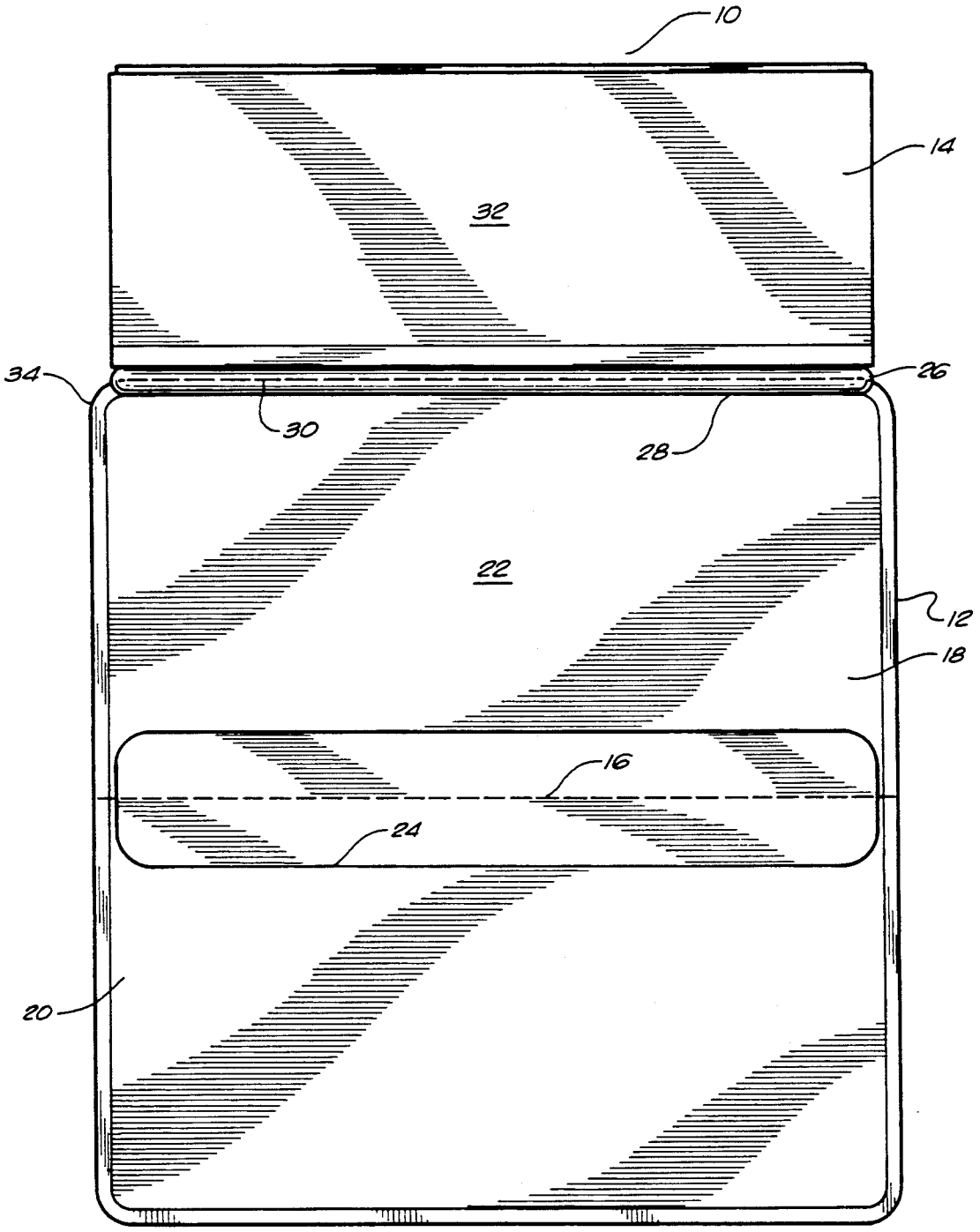
FIG. 1 is a frontal view of the information pad for checkbooks in accordance with the present invention.

Referring to FIG. 1, there is shown at 10, the information pad for checkbooks in accordance with the present invention. In particular, the information pad at 10 comprises a checkbook cover 12 and the information receiving pad 14.

The checkbook cover 12 is typically comprised of a plastic material. Although the checkbook cover as illustrated at 12 is of plastic material, it is also possible for the checkbook cover 12 to be made of vinyl or leather. The choice of materials for checkbook cover 12 is simply a matter of design choice and is not intended to be a limitation on the present invention. The important limitation as to checkbook cover 12 is that the checkbook cover be of a flexible material suitable for folding. Ideally, the checkbook cover 12 should be of the type suitable for folding and placing in one's pocket. The checkbook cover 12 includes a fold portion 16. Fold portion 16 may be an indentation, as illustrated in FIG. 1, or a form in the cover itself. The purpose of the fold portion 16 is to allow checkbook half 18 to be folded over and onto checkbook half 20. The checkbook cover 12 also includes an inner plastic sleeve 22 that is fastened to the inner side of the cover 12. This inner plastic sleeve 22 has a slot 24 that extends thereacross. Slot 24 serves to receive the back cover of a checkbook. In operation, a single checkbook may be placed onto slot 24 by sliding the back cover of the checkbook into the area between the checkbook cover 12 (the backing) and the inner plastic sleeve 22. As such, the checkbook will be retained in the area of checkbook half 20. To close the checkbook, the checkbook half 18 is folded across fold portion 16 and over the top of the checkbook residing in slot 24.

The information receiving pad 14 includes a hinge member 26 that extends between the information receiving pad 14 and the checkbook cover 12. This hinge member is seam welded at 28 to an edge of the inner plastic sleeve 22 within checkbook 12. The dotted line illustrated at 30 illustrates the perforation, or fold portion, of hinge member 26. By utilizing this fold portion 30, the information receiving pad 14 may be folded downwardly toward the checkbook half 18 and received therein. The checkbook half 18 may be utilized to receive the checkbook ledger, receipts, or other information pertinent to the checking operation.

Figure 3:
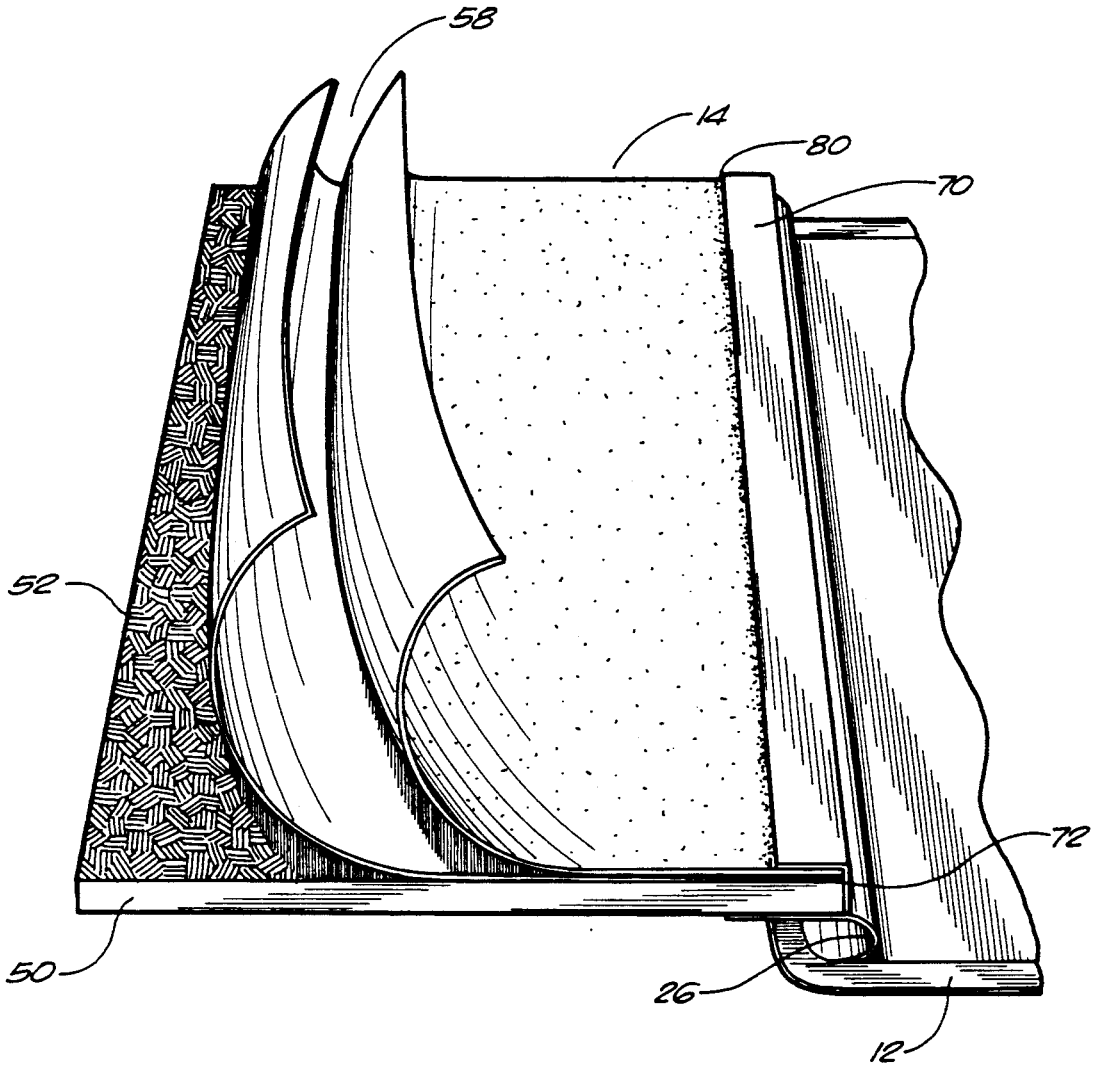
FIG. 3 is an isolated view, in perspective, of the information pad as separated from the checkbook.

The information receiving pad 14 is shown in particular detail in FIG. 3. Relative to FIG. 1, it can be seen that the writing surface 32 is facing outwardly. When the checkbook is unfolded, writing area 32 openly presents itself to the user when the information receiving pad 14 is folded outwardly. As such, the user of the checkbook can conduct calculations on the information receiving pad 14 by simply using the same pen as utilized to conduct the checking procedure. In addition, it can be seen, in FIG. 1, that the information receiving pad is extended outwardly beyond the upper edge 34 of the checkbook cover 12. This places the information receiving pad 14 in a convenient location for the checkbook user's use. In this arrangement, the pad 14 does not, in any way, interfere with the process of writing a check, recording a check, or balancing the checkbook. In addition, the information receiving pad 14 may be refolded into the checkbook cover 12 so as to mark a proper location within the ledger.

Figure 2:
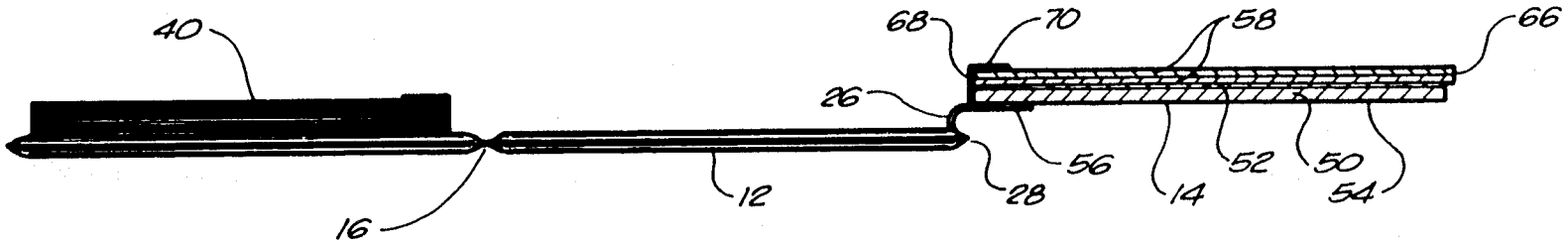
FIG. 2 is a side view, in expanded portion, of the information pad for checkbooks in accordance with the present invention.

Referring to FIG. 2, there is shown a side view, in rather exaggerated proportion, of the checkbook cover 12, the information receiving pad 14, and checkbook 40. In FIG. 2, the checkbook cover 12 has a fold portion 16 roughly in the center of the checkbook. The checkbook 40 is shown as inserted into the slot 24. Checkbook 40 is a standard checkbook having a plurality of individual checks contained therein.

In FIG. 2, the configuration of the information receiving pad 14 is shown. Information receiving pad is flexibly fastened by way of the hinge member 26 to the end 28 of the checkbook cover 12. It can be seen that the hinge member 26 is seam welded to the checkbook cover 12. Hinge member 26 curves outwardly from the point of attachment and then back inwardly. The hinge member 26 is flexible enough to allow the easy movement and folding of the information receiving pad 14 into the area of the checkbook cover 12. The information receiving pad 14 serves the purpose of receiving written information. Importantly, the information receiving pad should have a size less than the surface area of the checkbook cover 12. The information receiving pad 14 includes an backing layer 50 that has a first planar surface 52 and a second planar surface 54. The first planar surface 52, at the top of the backing layer 50, is a surface for recording written information. The backing layer 50 is generally a rigid planar member. Typically, the backing layer 50 is made up of a solid cardboard material. Hinge member 26 has a portion 56 that is fixedly fastened or detachably connected to the end surface of the second planar surface 54.

Overlying the first planar surface 52 of the backing layer 50 are a plurality of flexible sheets 58. These flexible sheets 58 extend in surface-to-surface contact with each other and with the backing layer 50. Typically, these flexible sheets are made of paper. These sheets of paper 58 are detachably connected to the backing layer 50. The sheets of paper 58 are suitable for the receipt of information from either pen or pencil.

It can be seen in FIG. 2 that the longitudinal edges 66 of the sheets of paper are aligned. Additionally, the edge 68 of the sheets of paper 58 and the backing layer 50 are also aligned. A wrap 70 covers this longitudinal edge 68 so as to maintain each of the sheets 58 and the layer 50 in proper position relative to each other. Wrap 70 may be attached to the end of the sheets by gluing, stapling, or other adhesive attachment. In this configuration, it is easy to lift the sheets 58 from the backing layer 50.

FIG. 3 is a detailed view showing the arrangement of the information receiving pad 14. In FIG. 3, the backing layer 50 is shown with the first planar surface 52 exposed. The plurality of flexible sheets 58 are shown as two in number; although much larger pads could be used. These flexible sheets 58 will overly the first planar surface 52 of the backing layer 50. Wrap material 70 is shown as maintaining the ends 72 of each of the sheets and layers in proper alignment. In this configuration, it can be seen that the sheets may be easily lifted without removal. The hinge area 26 extends downwardly from the wrap 70 for engagement with the checkbook cover 12. A line of perforations 80 may be formed on the flexible sheets 58 so as to assist in the detaching of the sheets 58 from the backing layer 50. This line of perforations 80 allows the sheet 58 to be removed along the edge of the wrap material 70. All of the sheets of the plurality 58 may be removed by pulling and tearing around the perforation.

Figure 4:
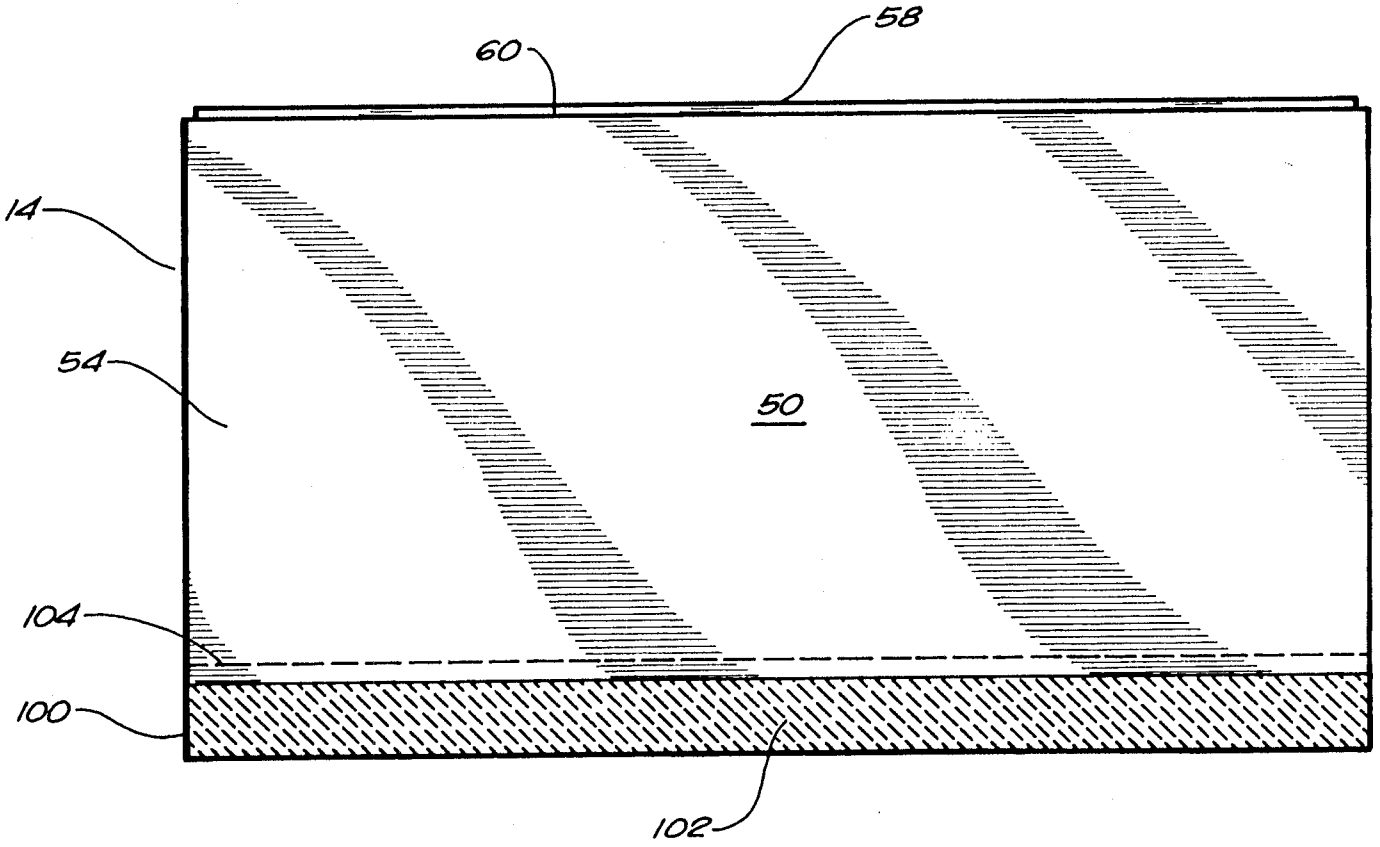
FIG. 4 is a rearward view of the information pad of the present invention.

FIG. 4 is a rearward view showing an alternative embodiment of the present invention. With reference to FIG. 3, it can be seen that the information receiving pad 14 includes a flexible adhesive section 100. The flexible adhesive section 100 is fastened to the second planar surface 54 of the backing layer 50. An adhesive strip 102 extends outwardly from this impression layer. The adhesive strip 102 is for selectively fastening the information receiving pad 14 to an edge of a foldable checkbook. Various types of adhesives may make up the adhesive strip 102. Ideally, the adhesive that makes up the adhesive strip 102 should be the type that is covered with an outer protective paper. When the paper is removed, the adhesive becomes exposed and available for use. There is a foldable portion 104 that is suitable for allowing the information receiving pad 14 to be folded, as indicated previously, into the foldable checkbook. The adhesive strip 102 is adjacent to the longitudinal edges 66 of the information receiving pad 14. The embodiment of FIG. 4 offers an alternative to seam welding or other integral fastening of the information receiving pad 14 to the checkbook. As such, the information receiving pad 14 may be separated from the checkbook itself and available for attachment and reattachment to various checkbook covers.

The present invention offers an improvement over the prior art in various ways. First, the present invention allows calculations to be carried out on the information pad, names to be recorded, dates to be recorded, and other vital information recorded. The positioning of the information receiving pad along an edge of the checkbook is quite beneficial. This keeps the pad 14 away from the checkbook ledger or the checkbook itself. It is maintained in a convenient location for use.

The embodiments as illustrated and discussed in this specification are intended only to teach those skilled in the art the best way known by the inventor to make and use the invention. Nothing in the specification should be considered as limiting the scope of the present invention. Many changes could be made by those skilled in the art to produce equivalent systems without departing from the invention. The present invention should only be limited by the following claims and their legal equivalents.

I claim:

1. An information pad for checkbooks comprising:

a checkbook cover of flexible material, said checkbook cover having a slot for receiving a checkbook therein; and information receiving means being flexibly fastened to said checkbook cover for receiving written information, said information receiving means having a size less than one-half the area of said checkbook cover, said information receiving means foldable within the area of said checkbook cover, said information receiving means comprising:

a backing layer having a first planar surface and a second planar surface;

a plurality of flexible sheets overlaying said first planar surface of said backing layer, said flexible sheets being detachably connected to said backing layer for receiving written information; and a hinge member extending between an edge of said backing layer and an edge of said checkbook cover to enable said information receiving means to be folded into the inner side of said checkbook cover, said hinge member being adhesively fastened to said second planar surface of said backing layer and adhesively fastened to said checkbook cover.

2. The pad of claim 1, said checkbook cover comprised of a plastic material, said checkbook cover having a fold portion such that part of said cover may fold over another portion of said checkbook cover.

3. The pad of claim 2, said checkbook cover having an inner plastic sleeve fastened to the inner side of said cover, said inner plastic sleeve having a slot extending thereacross, said slot for receiving a portion of a checkbook.

4. The pad of claim 1, said backing layer and said plurality of flexible sheets being connected along a longitudinal edge of said information receiving means.

5. The pad of claim 1, said backing layer being a rigid planar member of cardboard material.

6. An information pad for checkbooks comprising:

a checkbook;

a checkbook cover of flexible material, said checkbook cover having means for receiving said checkbook therein; said checkbook cover foldable and having a size suitable for covering an entire surface of said checkbook, and information receiving means being flexibly fastened to said checkbook cover for receiving written information, said information receiving means having a size less than the area of said checkbook cover, said information receiving means comprising:

a backing layer having a first planar surface and a second planar surface;

a plurality of flexible sheets overlaying said first planar surface of said backing layer, said flexible sheets being detachably connected to said backing layer for receiving written information, said information receiving means being removably fastened to an edge of said checkbook cover, said second planar surface of said backing layer having a flexible adhesive strip extending outwardly therefrom, said adhesive strip being positioned outwardly beyond a longitudinal edge of said backing layer.

* * * * *